US005340939A

United States Patent [19]

Kumagai

[11] Patent Number: 5,340,939

[45] Date of Patent: Aug. 23, 1994

[54] INSTRUMENT HAVING MULTIPLE DATA STORING TRACKS FOR PLAYING BACK MUSICAL PLAYING DATA

[75] Inventor: Tomoyuki Kumagai, Hamamatsu, Japan

[73] Assignee: Yamaha Corporation, Hamamatsu, Japan

[21] Appl. No.: 774,039

[22] Filed: Oct. 7, 1991

[30] Foreign Application Priority Data

Oct. 8, 1990 [JP] Japan ..... 2-271889

[51] Int. Cl.[5] ..... G10H 1/38; G10H 7/00

[52] U.S. Cl. ..... 84/609; 84/649

[58] Field of Search ..... 84/600–602, 84/609, 610, 613, 614, 634, 637, 649, 650, 666, 669

[56] References Cited

U.S. PATENT DOCUMENTS

| | | | |
|---|---|---|---|
| 3,781,452 | 12/1973 | Vauclain | 84/609 |
| 4,182,214 | 1/1980 | Wakeman | 84/642 |
| 4,344,345 | 8/1982 | Sano . | |
| 4,889,026 | 12/1989 | Abe | 84/611 |
| 4,899,632 | 2/1990 | Okamura | 84/601 |
| 4,930,390 | 6/1990 | Kellogg et al. | 84/611 |
| 4,936,183 | 6/1990 | Rauchi et al. | 84/610 |
| 5,092,216 | 3/1992 | Wadhams | 84/602 |
| 5,113,741 | 5/1992 | Nishikawa | 84/609 |
| 5,131,309 | 7/1992 | Nishikawa et al. | 84/601 |
| 5,225,620 | 7/1993 | Terada | 84/609 |

FOREIGN PATENT DOCUMENTS 62-150393 7/1987 Japan .

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An instrument for playing back musical playing data comprises an performance track and a replacement-performance track in which replacement-performance data with performance data. Usually, only the performance track is in use so that only the performance data is read and supplied to a tone generator. When playback timing touches to the timing that the replacement-performance data is recorded in the replacement-performance track, the performance data at the timing on the performance track is replaced with the replacement-performance data on the replacement-performance track, and the replaced data is supplied to the tone generator to be played back.

17 Claims, 20 Drawing Sheets

(A) SONG MODE

| 001 | T120 | 4/4 | S1 |
|---|---|---|---|
| BAR | TEMPO | TIME | SONG NO. |

(B) SONG RECORD

| 001 | T120 | 4/4 | BAK. |
|---|---|---|---|

(C) SEQUENCE RECORD

| 001 - 1 - 00 | S24 | C3 | G80% | V64 |
|---|---|---|---|---|
| BAR BEAT CLOCK | NOTE LENGTH | TONE PITCH | GATE TIME | VELOCITY |

(D) BACKING RECORD

| 001 - 1 - 00 | P01 |
|---|---|
| | PATTERN NO. |

(E) CBR RECORD

| 001 - 1 - 00 | P01 |
|---|---|
| | PATTERN NO. |

(F) PATTERN MODE

| P01 |
|---|
| PATTERN NO. |

(G) PATTERN RECORD

| P01 | 4/4 | CD | 1Ms |
|---|---|---|---|
| | | | THE NUMBER OF BARS |

(H) PART RECORD

| 01 - 1 - 00 | S48 | C#3 | G80% | V64 |
|---|---|---|---|---|

Fig.4

| |
|---|
| BOH |
| GATE TIME |
| KEY CODE |
| VELOCITY |

Fig.5 (A)

| |
|---|
| AOH |
| TIME INTERVAL |

Fig.5 (B)

| |
|---|
| FFH |

Fig.5 (D)

| |
|---|
| DOH |
| PATTERN NO. |

Fig.5 (C)

INSTRUMENT HAVING MULTIPLE DATA STORING TRACKS FOR PLAYING BACK MUSICAL PLAYING DATA

BACKGROUND OF THE INVENTION

1. Field of the Invention

The present invention relates to an instrument for playing back musical playing data and, more particularly, to an instrument for playing back musical playing data of multi-part.

2. Description of the Prior Part

In conventional instruments for recording and playing back musical playing data, such as a sequencer, musical playing data of melody data or performance data can be recorded on multi-tracks, and these data can be simultaneously played back.

On an edit mode, once new musical playing data is directly inserted into original musical playing data of a track, to delete the new data, all of the original musical playing data must be written again, also, to change the insert point of the new data, much operation to do that is necessary.

SUMMARY OF THE DISCLOSURE

It is therefore an object of the present invention to provide an instrument for recording and playing back musical playing data which allows a performer to readily insert new data by using a specific track for changing data.

In accordance with an embodiment of the present invention, an instrument for recording and playing back musical playing data, comprises:

a first track for storing performance data;

a second track for storing replacement-performance data to replace the performance data; and replacement means for replacing, when replacement-performance data is read from the second track in a playback mode, performance data in the first track with the replacement-performance data as playback data.

Also, in accordance with an embodiment of the present invention, said performance data in the first track includes a plurality of performance part data and said replacement-performance data in the second track includes one replacement-performance part data, and any one of the performance part data is replaced with the replacement-performance part data by said replacement means.

Further, in accordance with an embodiment of the present invention, said performance data in the first track includes a plurality of performance part data, said second track includes a plurality of tracks in each of which one replacement-performance part data is stored, and any one of the performance part data is replaced with the replacement-performance part data in any one of the tracks by said replacement means.

In the above-mentioned device embodiments, performance data in the playback mode is replaced, when the replacement-performance data is read from the second track, with the read data, resulting in that playback performance data is switched from the performance data to the replacement-performance data while the replacement-performance data is read.

BRIEF DESCRIPTION OF THE DRAWINGS

FIGS. 4A–4H show an example of display state of a display device.

FIGS. 5A–5D and 6 to 16 inclusive illustrate flowcharts showing a process of the sequencer.

DETAILED DESCRIPTION OF THE PREFERRED EMBODIMENTS

Figure 1:
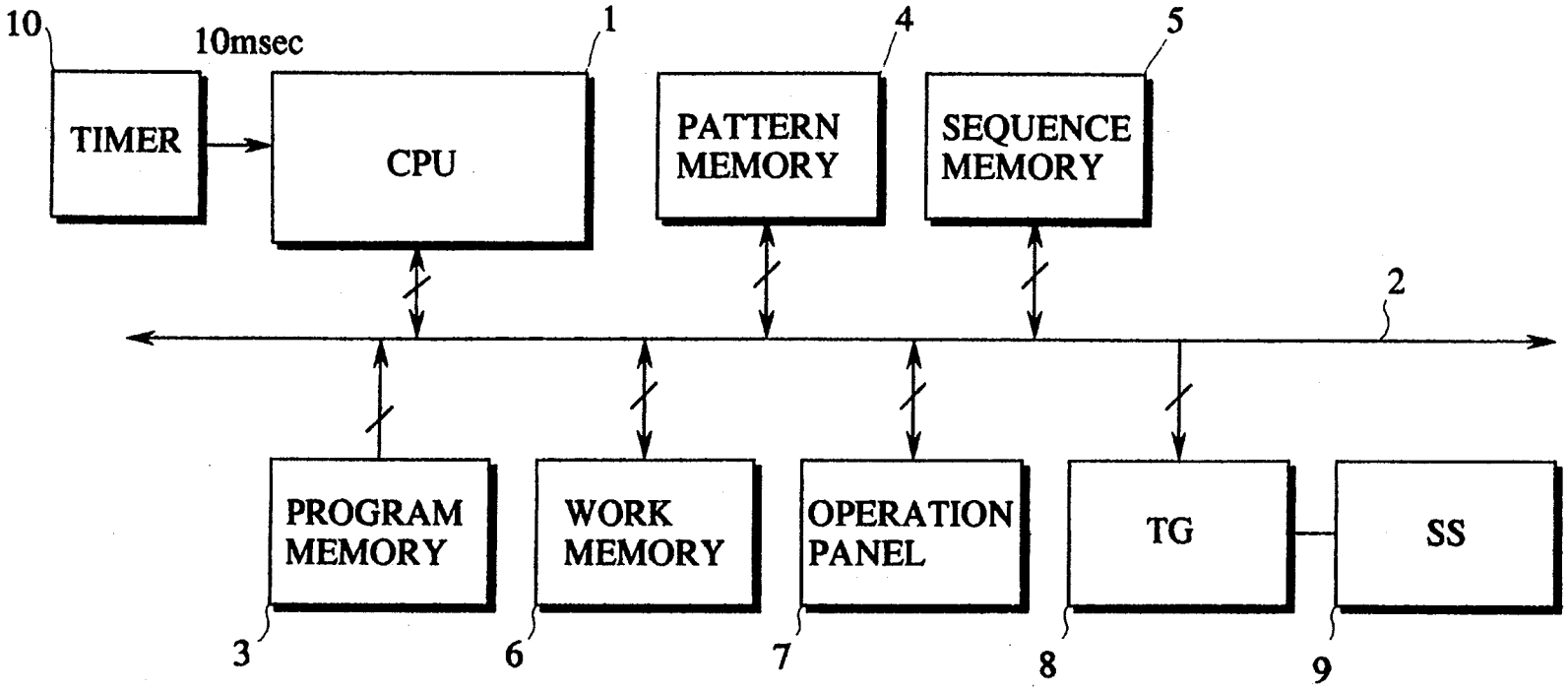
FIG. 1 is a block diagram of a sequencer according to an embodiment of the present invention.

Referring to the drawings, a sequencer according to an embodiment of the present invention is disclosed in detail as follows.

This sequencer is provided with eight tracks (TR=0 to 7) as musical playing data record areas (song tracks). Four tracks (TR=0 to 3) of them are for melody, named sequence tracks, and another four tracks (TR=4 to 7) of the remainder are for accompaniment-pattern designation data, named accompaniment tracks. Accompaniment-pattern designation data designates a accompaniment pattern. The accompaniment pattern is formed with three parts, chord, base and rhythm. Each of the patterns is stored in an accompaniment-pattern storage area (pattern track) other than the above-mentioned eight tracks. Each of the accompaniment pattern is identified by a pattern number. The fourth track of the tracks, TR=4 to 7, is a backing track which designates all parts of one accompaniment pattern, normally, three parts of the accompaniment pattern designated by this track are played back.

Three tracks of TR=5 to 7 are a chord track, a base track and a rhythm track, respectively. The chord track designates only a chord part of accompaniment pattern, the base track for only a base part, and the rhythm track for only a rhythm part. When a part is designated in a certain section by a track of these tracks, a part of the backing track corresponding to the designated part is replaced with the designated part for the section during playback. A part of the accompaniment pattern is designated by a pattern number, and a replace section is designated by replace timing and the number of bars.

FIG. 1 illustrates a block diagram of the sequencer.

The sequencer is controlled by a CPU 1. The CPU 1 is connected to a program memory 3, a pattern memory 4, a sequence memory 5, a working memory 6, a operation panel 7, and a tone generator 8 through a bus 2. The CPU 1 is also connected to a timer 10 which outputs a interrupt trigger for each 10 ms thereto. The tone generator 8 is connected to a sound system 9. The program memory 3 configured with a ROM is a memory which stores a program as shown in a flowchart stated later. The pattern memory 4 is a memory which stores the above-mentioned accompaniment patterns. The sequence memory 5 is a memory which has musical playing data storage areas for above-mentioned eight tracks (TR=0 to 7). The pattern memory 4 and the sequence memory 5 are configured with RAMs backed up by a battery. The work memory 6 has registers in which various data, which is generated while musical playing data is inputted for record or while musical playing data is played back, is temporarily stored. The work memory 6 is configured with a RAM.

The tone generator 8 is a circuit which generates a musical tone signal based on the musical playing data read from the sequence memory 5. The tone generator 8 has tone generation channels which can simultaneously play back the musical playing data in the eight tracks of the sequence memory 5. The sound system 9 is a circuit for amplifying the musical tone signal generated by the tone generator 8, and outputting it from a speaker or the like.

Figure 2:
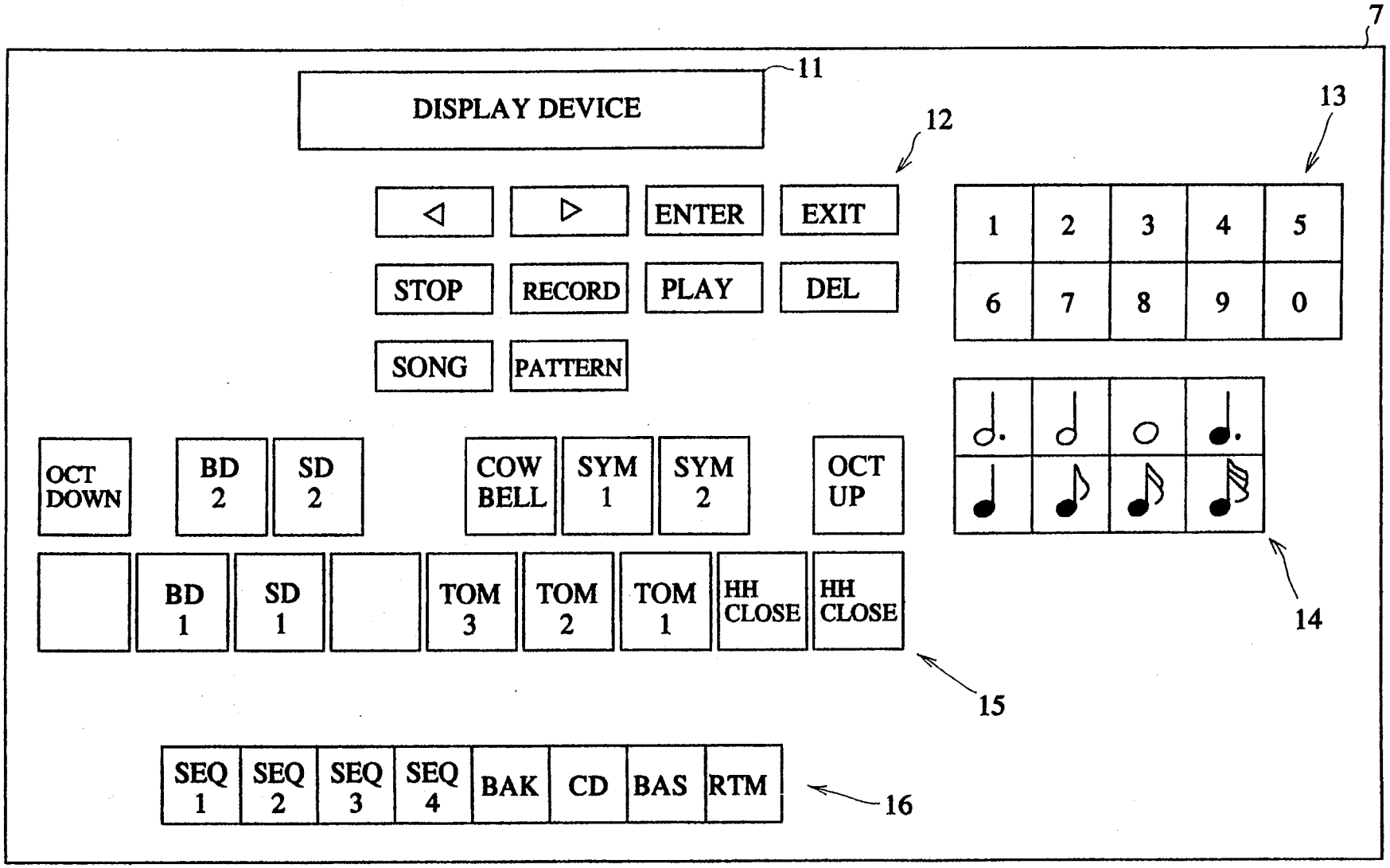
FIG. 2 is a plane view of an operation panel of the sequencer.

FIG. 2 shows a schematic block diagram of the above-mentioned operation panel 7. The operation panel 7 is provided with a mode key 12 for changing various modes of the sequencer, a ten key 13 for inputting numerical values, a note key 14 for inputting note kind, a multi-function key 15 for designating rhythm instruments when a tone pitch and a rhythm pattern are inputted, and a track selection key 16 for selecting tracks to back up or record. The operation panel 7 is also provided with a display device 11 of LED matrix type, display contents thereof being switched according to a set mode, and numerical values inputted from various keys or the like being displayed thereon.

Figure 3:
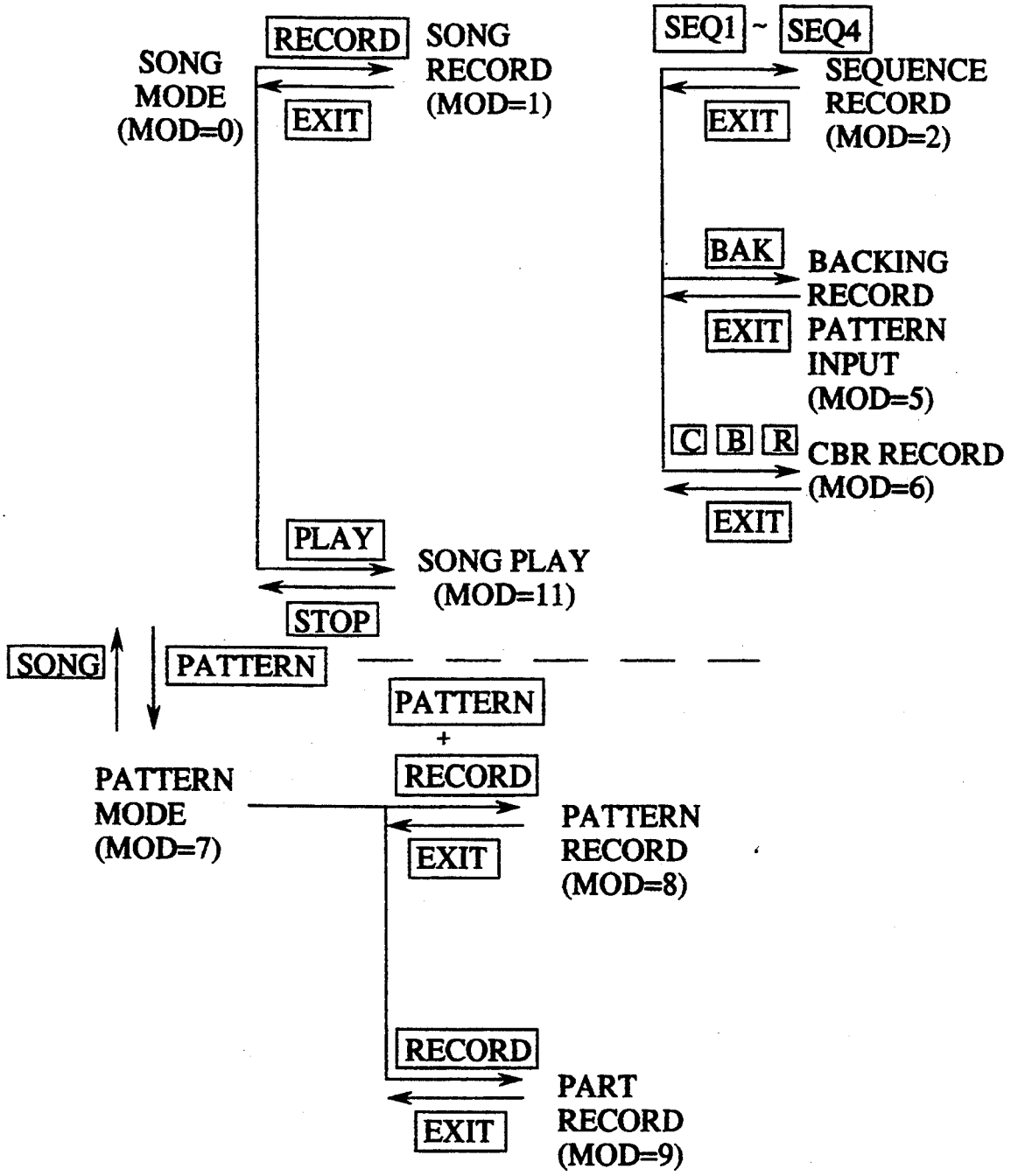
FIG. 3 shows a mode configuration of the sequencer.
Figure 6:
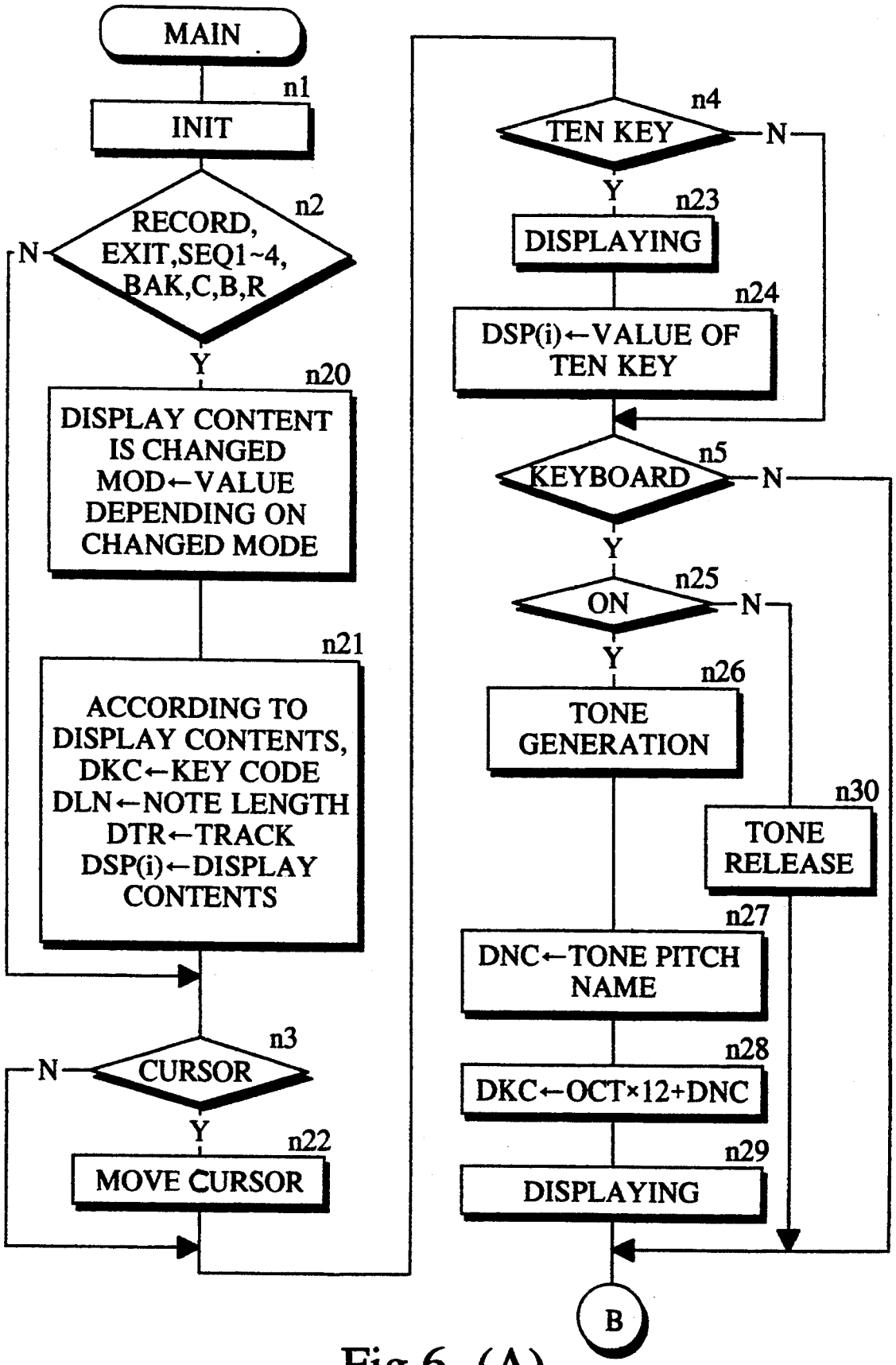
Figure 6:
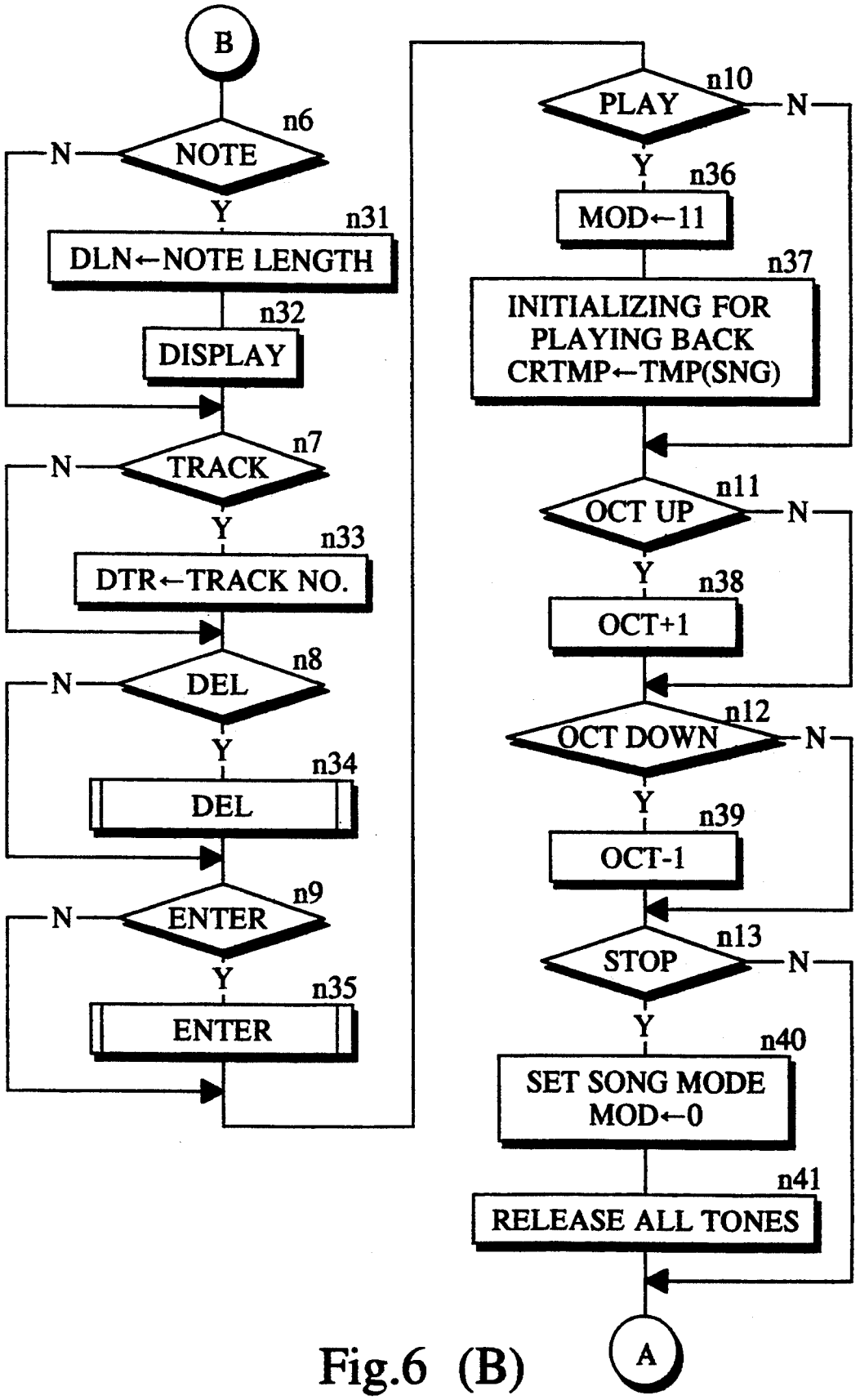

FIG. 3 shows mode organization of the sequencer.

The upper modes consists of a song mode (MOD=0) and a pattern mode (MOD=7). Switching of the upper mode can be done by a SONG key and a PATTERN key, respectively. The song mode allows a song record mode (MOD=1) for inputting the musical playing data to perform automatic playing, and a song play mode (MOD=11) for playing back the record data, to move therefrom. The song record mode allows a sequence record mode (MOD=2), a backing record mode (MOD=5), or a CBR record mode (MOD=6) depending on a track to be written, to move therefrom. The sequence record mode (MOD=2) is a mode in which musical playing data , such as melody data, is written into the sequence tracks (TR=0 to 3). The written data consists of note data, time interval, and end data. The backing record mode (MOD=5) is a mode in which pattern designation data is written into the backing track (TR=4) to designate a accompaniment pattern. The CBR record mode (MOD=6) is a mode in which replacement data (pattern designation data) is written into the chord track (TR=5), the base track (TR=6), and the rhythm track (TR=7). Operation of the track selection key 16 allows the song record mode (MOD=1) to move to the above-mentioned modes therefrom, and then, operating an EXIT key enables a performer to return to the song record mode.

It is possible to enter the pattern record mode (MOD=8) or the part record mode (MOD=9) from the pattern mode (MOD=7). The pattern mode is a mode in which an accompaniment pattern is written into the pattern memory 4. In the pattern record mode, a pattern number for identifying an accompaniment pattern, the number of bars of the pattern, and so on are written. In the part record mode, musical playing data of an accompaniment pattern is inputted using the above-mentioned note key 14, or the like.

FIGS. 4(A) to (H) show examples of displays of the display device 11. FIG. 4(A) shows an example in the song mode. In the song mode, a bar number, a tempo value, a time (meter) value, and a song number are displayed from the left side. An under line represents an area that a cursor is movable using a cursor key. Input of numerical values using the ten key 13 on the cursor place causes change the values thereof. This means that in the song mode, a performer can change the bar number, the tempo value, and the song number. The time value is decided depending on the selected song (song number), this means the performer can't input the time value.

FIG. 4(B) shows an example in the song record mode.

In this mode, the bar number, the tempo value, the time value, and the track number are displayed on the display device 11. The bar number, the tempo value and the time value are available to input from the ten key, a track number can be selected using the track selection key 16.

FIG. 4(C) shows an example in the sequence record mode.

In this mode, the bar number, a beat, the number of clocks, the note length, the tone pitch, gate time and a key velocity are displayed on the display device 11. This mode is a mode in which note data for automatic playing is inputted by a step way. Tone generation timing of note data is specified by the bar number, the beat and the number of clocks, and tone generation time period of the note data is specified by the note length and the gate time. The note length is designated by the note key 14. The gate time is a ratio of generation time to the note length. The tone pitch is designated by the multi-function key 15 constituted by a keyboard arrangement of one octave. An octave-up key and an octave-down key are provided at both sides of the multi-function key 15, allowing the inputted tone pitch to make octave-up and octave-down at the same tone pitch name. The key velocity is inputted from the ten key 13.

FIGS. 4(D) and (E) show examples in the backing record mode and the CBR record mode. In these modes, the bar number, the beat and the number of the clocks are displayed on the display device 11 as well as the sequence record mode, and further, an accompaniment pattern number to be played at the timing is displayed.

FIG. (F) show an example in the pattern record mode.

The pattern record mode is a mode in which an accompaniment pattern is written into the pattern memory. In the display device 11, the pattern number, the time value, a part name, and the number of the bars of the the accompaniment pattern are displayed from the left side thereof. The characters printed on the track selection key 16 are used as the part name, for example, "CD" is used for the chord track, "BAS" for the base track, and "RTM" for the rhythm track.

FIG. 4(H) shows an example in the part record mode.

In this mode, musical playing data for an accompaniment is inputted by the step way, so that the display contents are the same as the sequence record mode.

FIG. 5 illustrates a format of the musical playing data recorded in the pattern memory 4 and the sequence memory 5. FIG. 5(A) shows a format of the note data, FIG. 5(B) shows a format of the time interval data, FIG. 5(C) shows a format of the pattern designated data, and FIG. 5(D) show a format of the end data. These data are identified with "BOH", "AOH", "DOH" and "FFH", respectively. In the case of the note data, the gate time, the key code and the velocity are written into the three bytes areas which the "BOH" follows. In the case of the time interval data, the time interval value is written into the one byte area which the "AOH" follows. In the case of the pattern designation data, the pattern number is written into the one byte area which the "DOH" follows.

FIGS. 6 to 16 illustrate flow charts showing the processes of the sequencer.

When the power of the sequencer is turned on, first, an initial resetting process to the registers or the like is performed (n1), enabling the sequencer to start operation. After that, whether any key of the operation panel 7 is depressed is judged, namely whether an on-event or an-off event of any key occurs is judged (n2 to n13). If any event occurs, the process according to the event is performed (n20 to n41).

If the RECORD key, the EXIT key or the track selection key is depressed, a mode is changed according to the mode organization shown in FIG. 3. That is, display contents of the display 11 is changed (refer to FIG. 4), and the value depending on the changed mode is set into a mode register MOD (n20). Also, specified values are set into the various registers, DKC, DLN, DTR, and DSP(i), according to the display contents of the display device 11. If the cursor key is depressed, the cursor is moved according to the cursor key (n22). If a ten key is depressed, the inputted numerical value is displayed at the cursor position (n23), and the displayed value is stored into the register DSP(i) corresponding to the cursor position (n24). If the multi-function key 14 is depressed as a keyboard for designating a tone pitch, a tone generation process is performed (n26), the tone pitch name identified by the depressed key is stored into a display-tone-pitch-name register DNC (n27), and tone pitch data modified with an octave register OCT is stored into the register DKC (n28). At n29, these data is displayed on the display device 11 (n29).

If the off event of the keyboard is detected, tone release process is performed (n30). If the note key is depressed, the note length designated by the note key is stored into the display-note-length register DLN (n31), the note length being displayed on the display device 11 (n32). If the track selection key is depressed, the track number designated by the track selection key is stored into the display-track-number register DTR, the track number being displayed on the display device 11 (n33). If the DEL key is depressed, a delete process is performed (n34). If the ENTER key is depressed, a process depending on the status at the moment is performed (n35). If the PLAY key is depressed, "11" is set into the MOD register, then, being performed an initial setting process for playback (n37). The initial setting process for play back is a process in which each pointer in every tracks, in which musical playing data is stored to play back a song, is set to the start address. If the octave-up key or the octave-down key is depressed, "1" is added or subtract to or from the octave register OCT (n38, n39). If the stop key is depressed, the song mode is set, display contents is changed, and "0" is set into the MOD register (n40). Then, if any channel is in tone generation, release data is sent to all channels to release all musical tones (n41).

Figure 7:
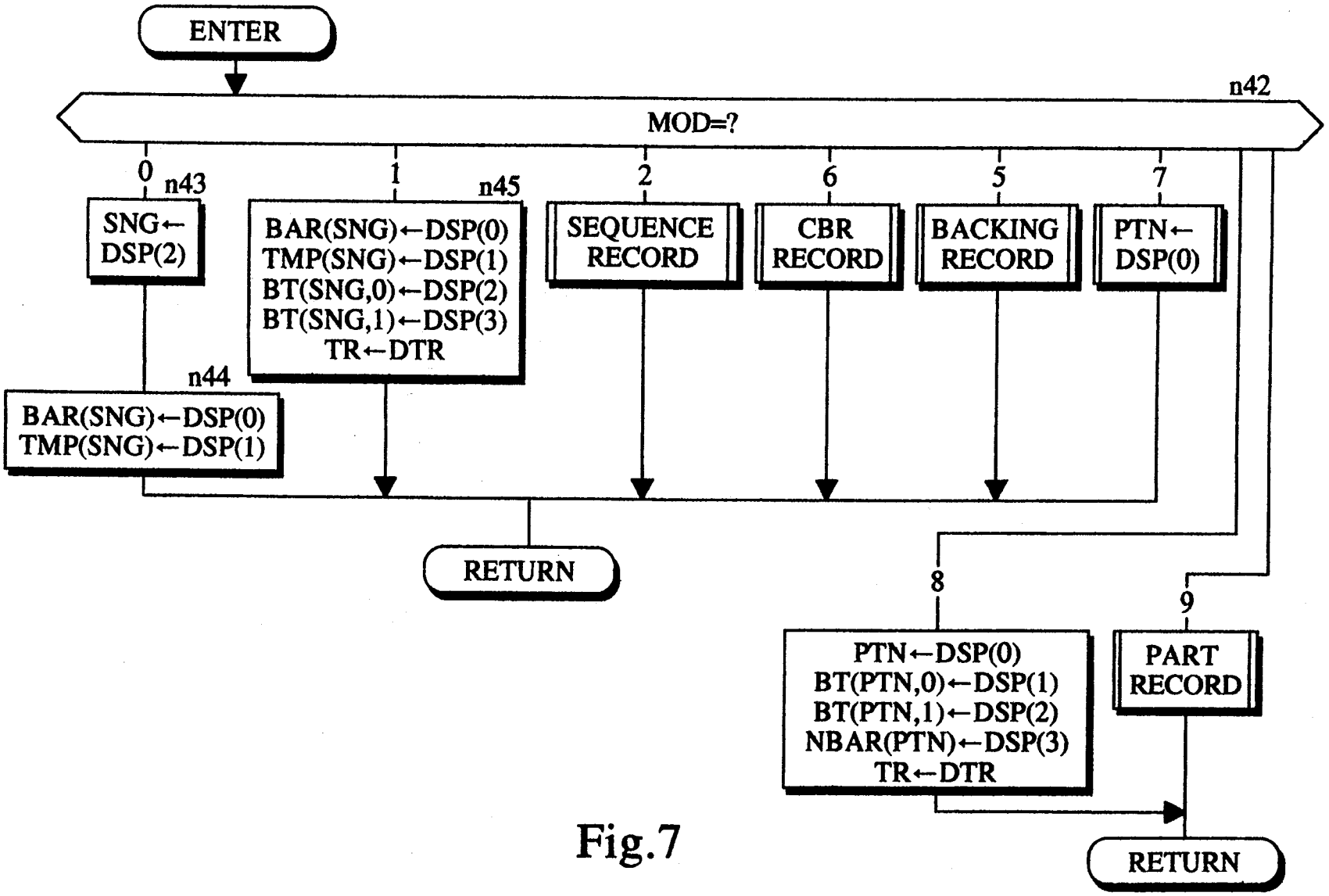

FIG. 7 shows a flow chart for the enter key-on.

If the enter key is depressed, display data of the display device 11 is set into the specified register according to the mode at that time. If the song mode (MOD=0) has been set, numeral value displayed at the cursor position is set into the song number register SNG, the bar number register BAR, and the tempo data register TMP (n43, n44). Also, if the song record mode (MOD=1), the pattern mode (MOD=7), and the pattern record mode (MOD=8) have been set, the display data at that time is stored into the specified registers (n45). If the sequence record mode (MOD=2) has been set, the process of the sequence record mode is performed. If the CBR record mode (MOD=6), the backing record mode (MOD=5) and the part record mode (MOD=9) have been set, the CBR record mode, the backing record mode and the part record mode are performed, respectively.

Figure 8:
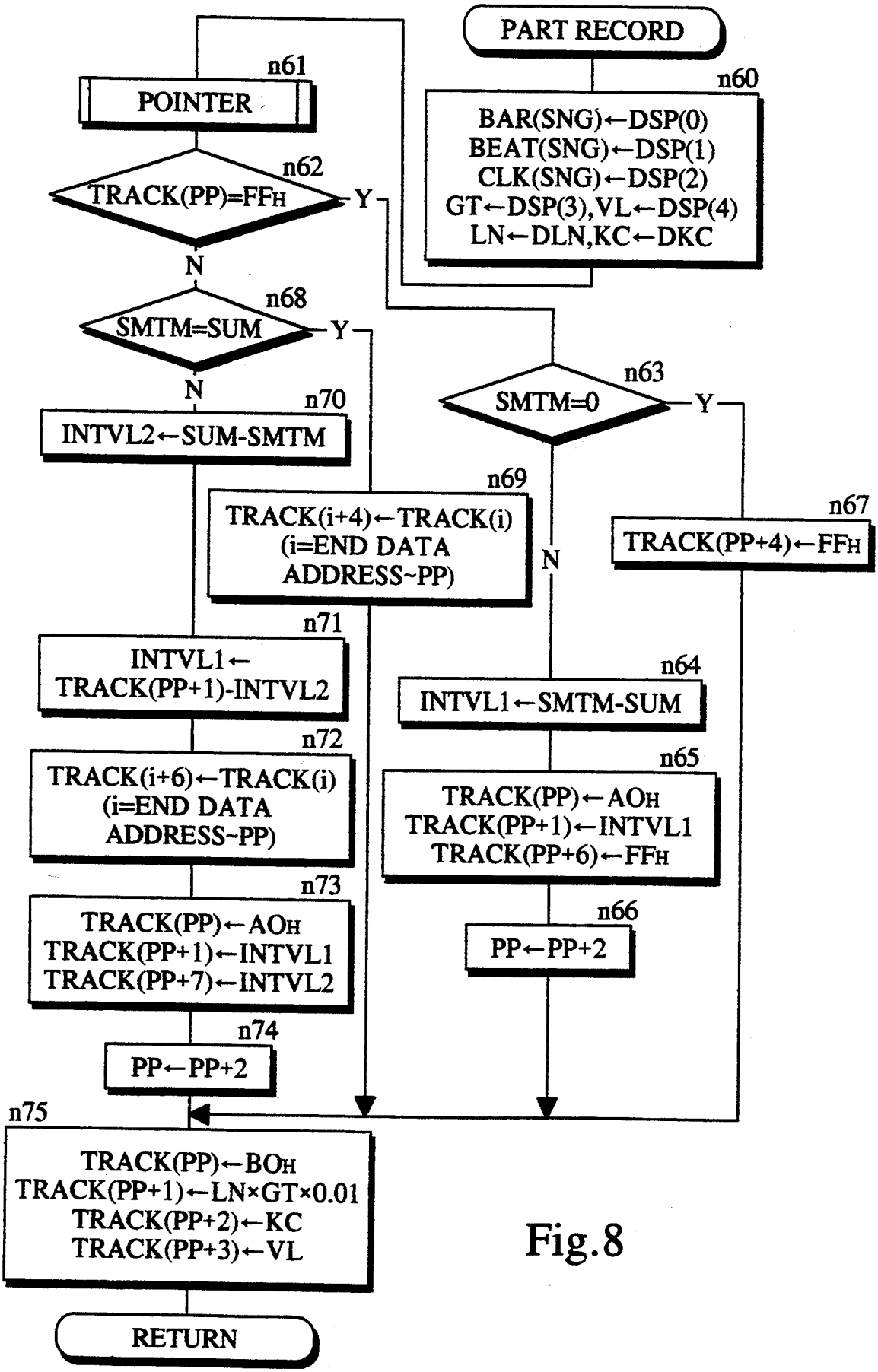
Figure 9:
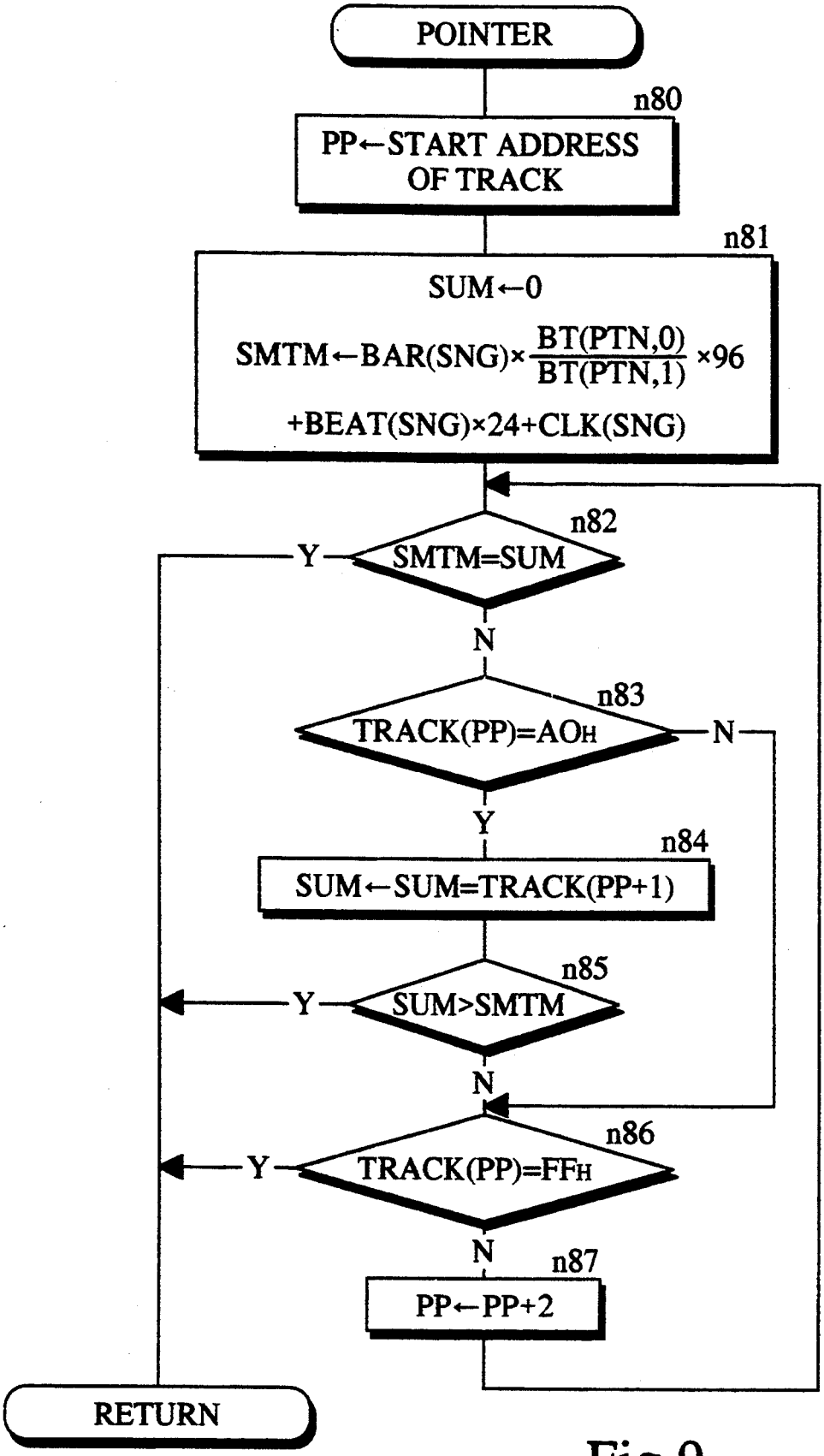

FIG. 8 shows a flow chart for the process of the part record mode. This process is performed when the ENTER key is depressed in the pattern mode after the record key is depressed (i.e., the status of MOD=9 is set). In the process, first, display data of the display device 11 is set into the specified registers (n60). The display data is shown in FIG. 4 (H). Next, the designated track (PATTERN(PTN,TR,i)), abbreviated as track (i) in the drawings, is searched to find data of the timing specified by the bar number, the beat and the number of the clocks (n61). The pointer process shown in FIG. 9 is the search process. The searched data of "FFH" means data-appendix to the end data of the pattern, while, any data other than the "FFH" means data-insertion into the pattern.

If the data is "FFH", time interval data represents a time interval from the immediate preceding note data is written (n64 to n66), and then, the note data inputted at this time is appended. The data of "FFH " is always written at the end point of the musical playing data, so that after the data-appendix is executed, the data of "FFH" is written at the new end point. If no data exists on the track (SMTM=0), the "FFH" is written at the point which precedes the start address by four bytes (n67), and then the note data writing process (n75) is performed.

If the track (PP)< >"FFH", that means the data-insertion into the pattern. If the new note data has the same timing as the previously written note data (old data) (SMTM=SUM), the old data is shifted by four bytes to insert the new data (n69), and then the process goes to the step n75. While, if the new note data should be inserted between two data each timing of which is different (SMTM< >SUM), the time interval data between the two data is divided into two data based on the timing data of the new note data, and then the data is stored into the registers INTVL1 and INTVL2 (n70, n71). Next, the previously data (old data) is shifted by the bytes of the above-mentioned time interval data and the new note data (n72), after that, the time interval data is written (n73) and the new note data is inserted (n74, n75).

FIG. 9 shows a flow chart for a process of the pointer operation. This process is a subroutine, executed when recording and playing back, in which musical playing data at the timing specified by a bar number, a beat and the number of clocks is searched in a specified track. The pointer points "BOH" of note data or "FFH" of the end code. First, the start address (head address) of the designated track (PATTERN(PTN,TR,i)), abbreviated as track (i) in the drawings, is set into the PP register (n80). Next, a SUM register, which accumulates and stores the time interval value read from the track, is cleared, the timing data designated at this time is converted into the number of clocks, and then, the number of the clocks is set into the register SMTM (n81).

After that, reading of the musical playing data is started from the beginning of the track. If the reading touches the time interval data (AOH), the data is added to the SUM register (n83, n84). In this process, if the content of the SUM register is equal to or greater than one of the SMTM register, the process returns (n82, n85). If the reading touches the end code "FFH", the process also returns (n86). In this process, when the written (inserted) data has the same timing as previously written note data, i.e., SMTM=SUM, it is unnecessary to write a new time interval data, so that "2" is added to the register PP (n87), and the process returns (n82).

The part record mode process in FIG. 8 and the point operation process in FIG. 9 are also performed in the sequence record mode (MOD=2: see FIG. 4(C)). In the process of the part record mode, a track (i) means a track PATTERN(PTN,TR,i) designated by a pattern number PTN and a track number TR, while, in the process of the sequence record mode, the track (i) means a track TRK(TR,i) designated by a track number of a designated song number. The pointer operation process is performed as to the content of the register TRK(TR,i) as well as in the CBR record mode process and the backing record mode process stated later.

Figure 10:
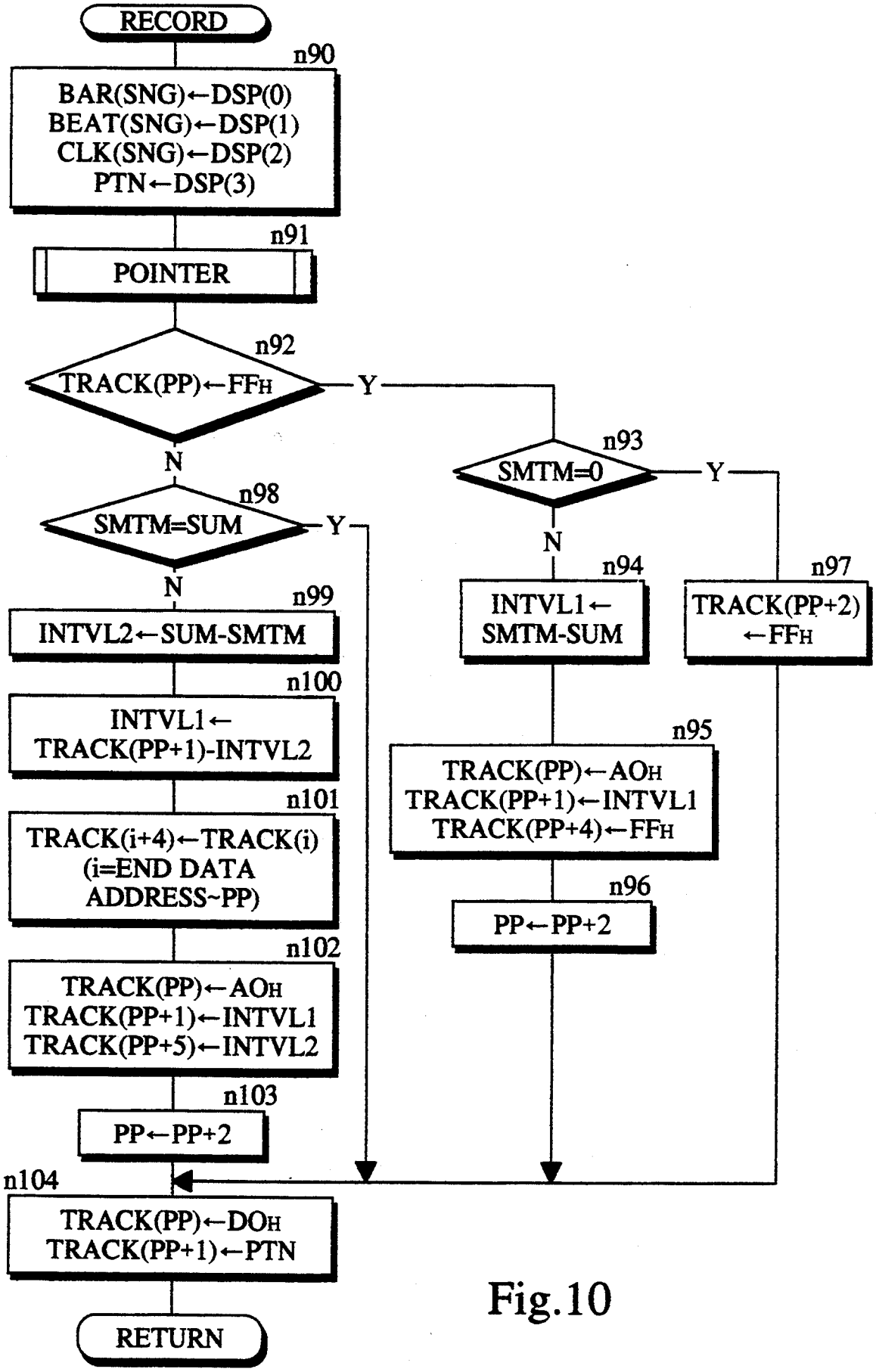

FIG. 10 shows a flow chart of the CBR record mode process and the backing record mode process. This flow chart is performed when the ENTER key is depressed while any track out of the tracks, TR=4 to 7, is selected in the song record mode. In this process, pattern designated data is written on the backing track, the C track, or the R track.

First, the display contents of the display device 11 are set into the specified registers (n90). FIGS. 4(D) and (E) show the display contents. Next, the designated track (TRK(TR,i)), abbreviated as track (i) in the drawings, is searched to find data of the timing specified by the bar number, the beat and the number of the clocks (n91). The searched data of "FFH" means data-appendix to the end data of the pattern, while, any data other than the "FFH" means data-insertion into the pattern.

If the data is "FFH", time interval data represents a time interval from the immediate preceding pattern designation data is written (n94 to n96), and then, the pattern designation data inputted at this time is appended. The data of "FFH" is always written at the end point of the musical playing data, so that after the data-appendix is executed, the data of "FFH" is written at the new end point. If no data exists on the track (SMTM=0), the "FFH" is written at the point which precedes the start address by two bytes (n97), and then the pattern-designation-data-writing-process (n104) is performed.

If the track (PP)< >"FFH", that means the data-insertion into the pattern. If the new pattern designation data has the same timing as the previously written pattern designation data (old data) (SMTM=SUM), the process goes to the step n104. While, if the new pattern designation data should be inserted between two data each timing of which is different (SMTM< >SUM), the time interval data between the two data is divided into two data based on the timing data of the new pattern designation data, and then the data is stored into the registers INTVL1 and INTVL2 (n99, n100). Next, the previous data (old data) is shifted by the bytes of the above-mentioned time interval data and the new pattern designation data (n101), after that, the time interval data is written (n102) and the new previous data is inserted (n103, n104).

As the above-mentioned process represents, if the pattern designation data to be inserted has the same timing as any previously written pattern designation data, both of the new and old data are not written, simultaneously. In this case, the new data is written on the old one (n98 to n104). That's why only one pattern can be written on a track, i.e., a track can designate only one pattern.

Figure 11:
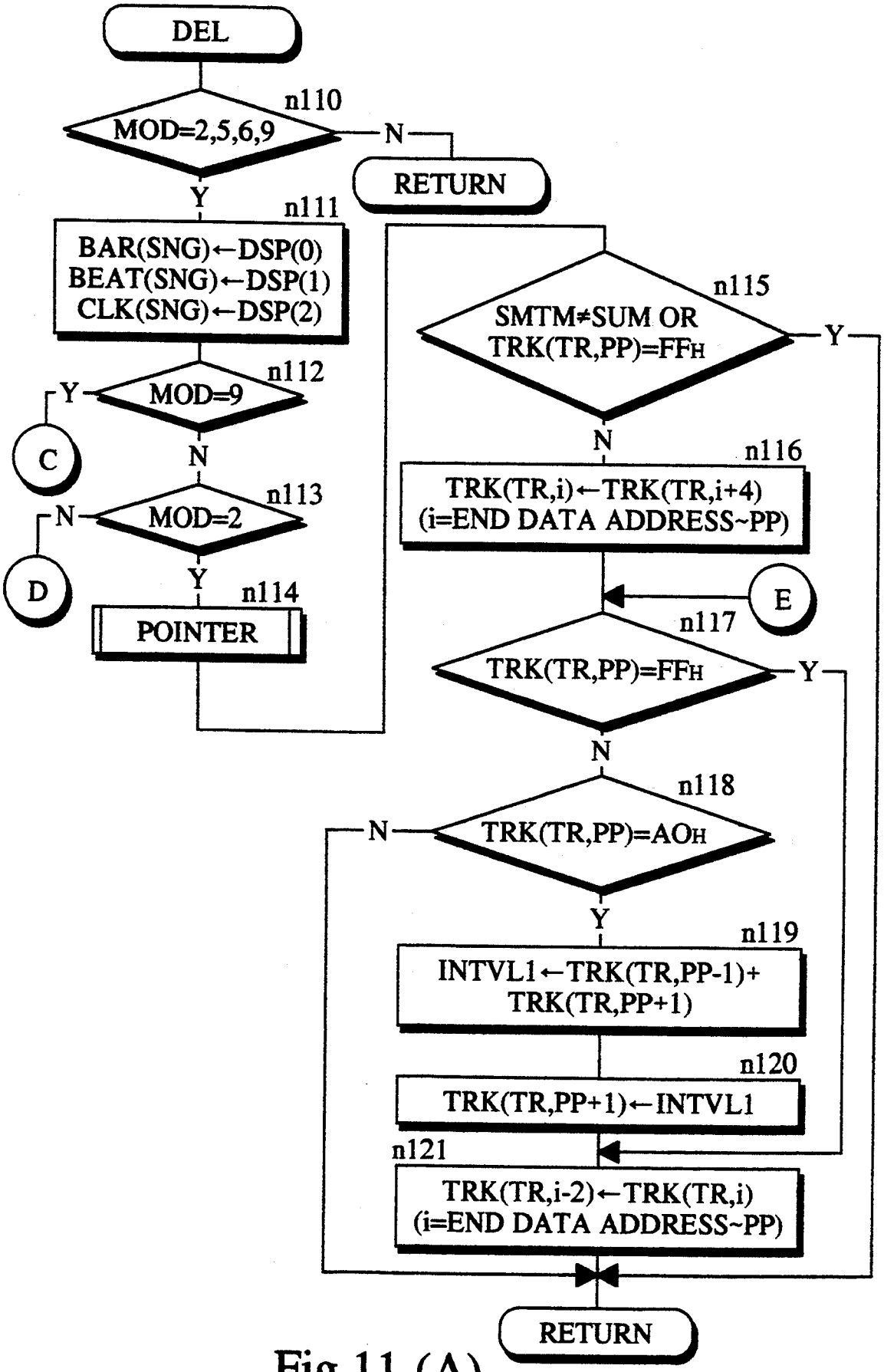
Figure 11:
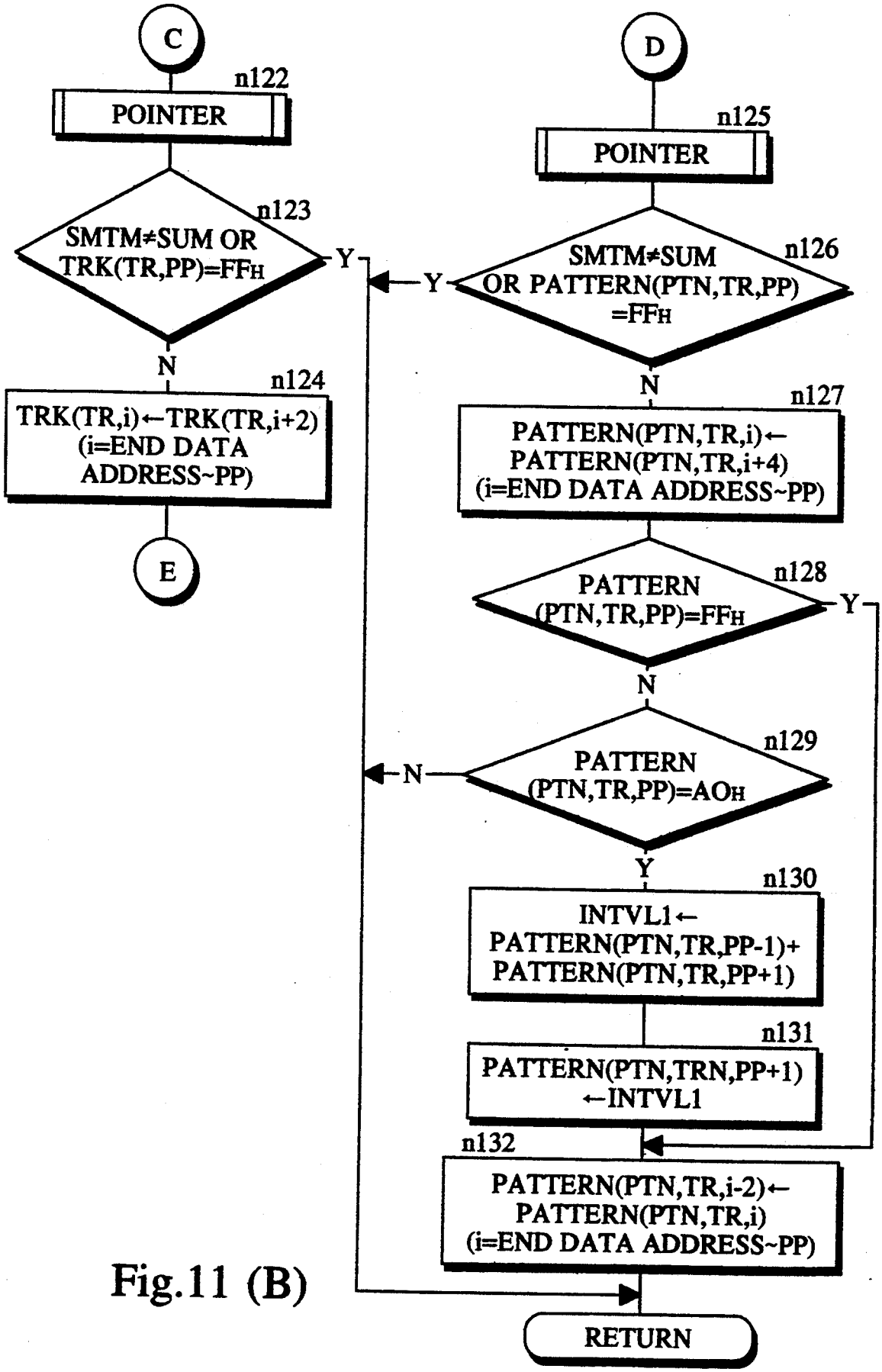

FIG. 11 shows a process executed when the DEL key is depressed. This process is a process in which data once written is deleted in various record modes, the sequence record mode, the part record mode, and backing and CBR record mode. If the DEL key is depressed in any mode other than those record modes, this process is skipped (n110). In the above-mentioned record modes, the bar number, the beat, and the number of clocks are set into the specified registers (n111). The timing decided by these data designates data to be deleted, and the process of the deletion is performed depending on each record mode.

In the sequence record mode (MOD=2), the pointer operation process is performed to delete designated data (n114). In the step n114 (pointer subroutine), the pointer PP points the first data ,"BOH" or "FFH", in the condition of SUM >=SMTM. If, after that subroutine, there is no data at the designated timing, i.e., SMTM< >SUM, or the designated data is the end code of "FFH", this deletion routine (DEL routine) directly returns without any operation.

If, in the DEL routine, the designated timing meets note data of "BOH", this data is deleted by shift-up of the following data (n116). The immediate preceding data of the deleted data is time interval data . If time interval data (AOH) follows the deleted data (n118), they are combined (n119 and n120), the unnecessary data of two bytes is deleted (n121), the process returns. If the end code follows the deleted data, the time interval data immediately preceding the end code is unnecessary, so that this time interval data is deleted (n121) and the process returns. If note data follows the deleted data (this case occurs when each of note data to be generated at the same time is deleted), the process returns from the step n118.

In the part record mode (MOD=9), a similar process to the DEL process is performed. That is, the pointer operation process is performed (n125), the search process is executed to find the designated data.

If there is no data at the designated timing, i.e., SMTM< >SUM, or the designated data is the end code of "FFH", this routine directly returns from the step n126 without any operation.

If the designated timing meets note data of "BOH", this data is deleted by shift-up of the following data (n127). The immediate preceding data of the deleted data is time interval data . If time interval data (AOH) follows the deleted data (n129), they are combined (n130 and n131), the unnecessary data of two bytes is deleted (n132), the process returns. If the end code follows the deleted data, the time interval data immediately preceding the end code is unnecessary, so that this time interval data is deleted (n132) and the process returns. If note data follows the deleted data (this case occurs when each of note data to be generated at the same time is deleted), the process returns from the step n129.

In the backing record mode (MOD=5) or the CBR record mode (MOD=6), the pointer operation process is performed (n122), the designated data is searched. If there is no data at the designated timing, i.e., SMTM< >SUM, or the designated data is the end code of "FFH", this routine directly returns from the step n123 without any operation. If the designated timing meets pattern designation data of "DOH", this data is deleted by shift-up of the following data (n124). After the deletion, the process goes to the step n117 to do a process for the time interval data.

Figure 12:
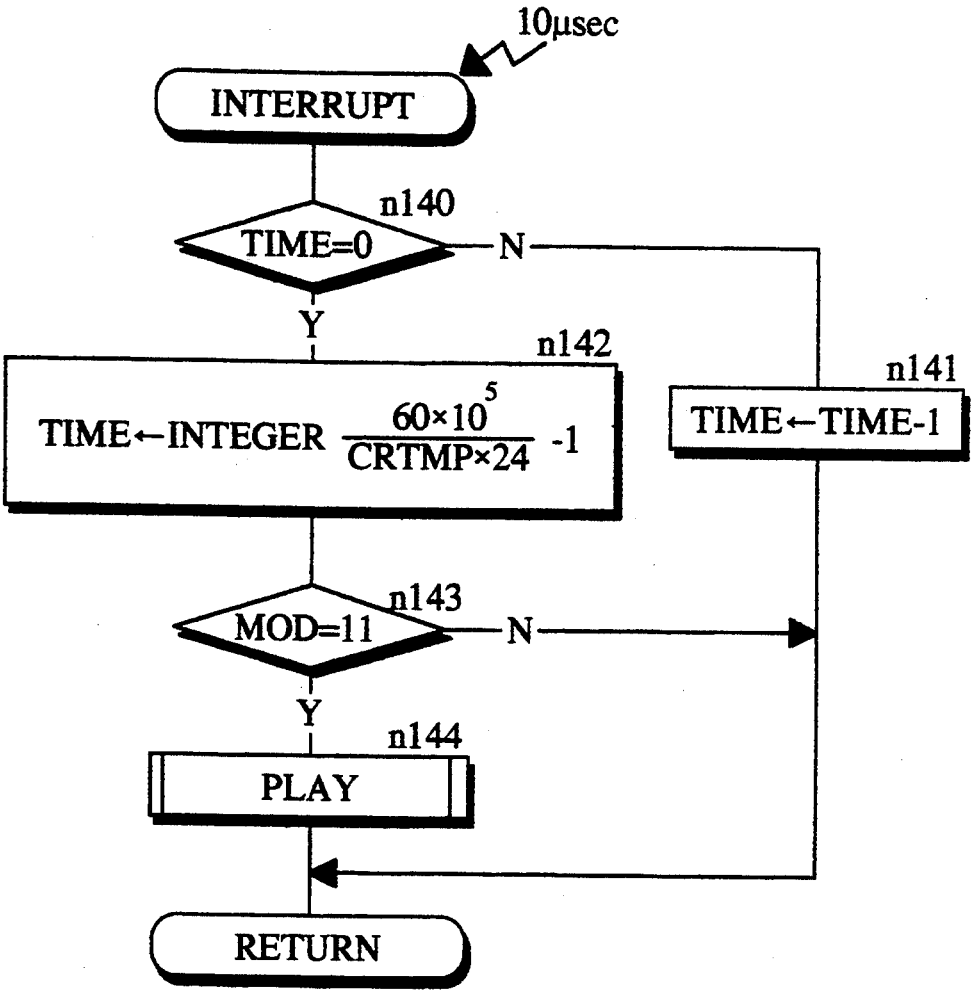

FIG. 12 shows a flow chart of a timer interrupt process.

This timer interrupt process is valid in only the play (automatic play) mode. First, whether the content of the timer register TIME is "0" or not is judged (n140). If it is not "0", "1" is subtract from the register TIME (n141), and the process returns. If it is "0", the CPU calculates time per one clock according to the present tempo value which is preset, and the time is set into the register TIME (n142). Also, in the step n142, "1" to be presently subtracted is subtracted. In the step n143, whether the present mode is the play mode or not is judged. If not play mode, the process directly returns, otherwise, i.e., now is in play mode, the play mode process (PLAY process) is started (n144).

Figure 13:
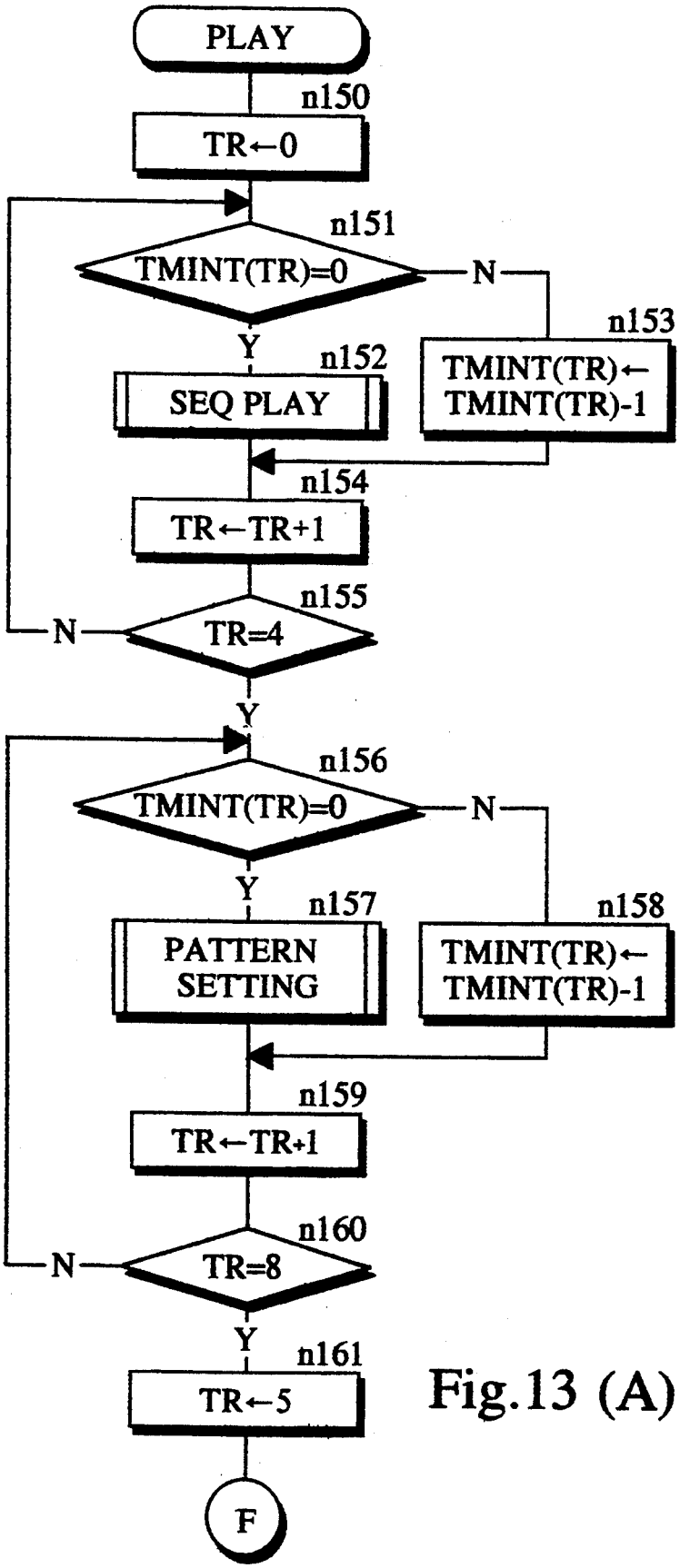
Figure 13:
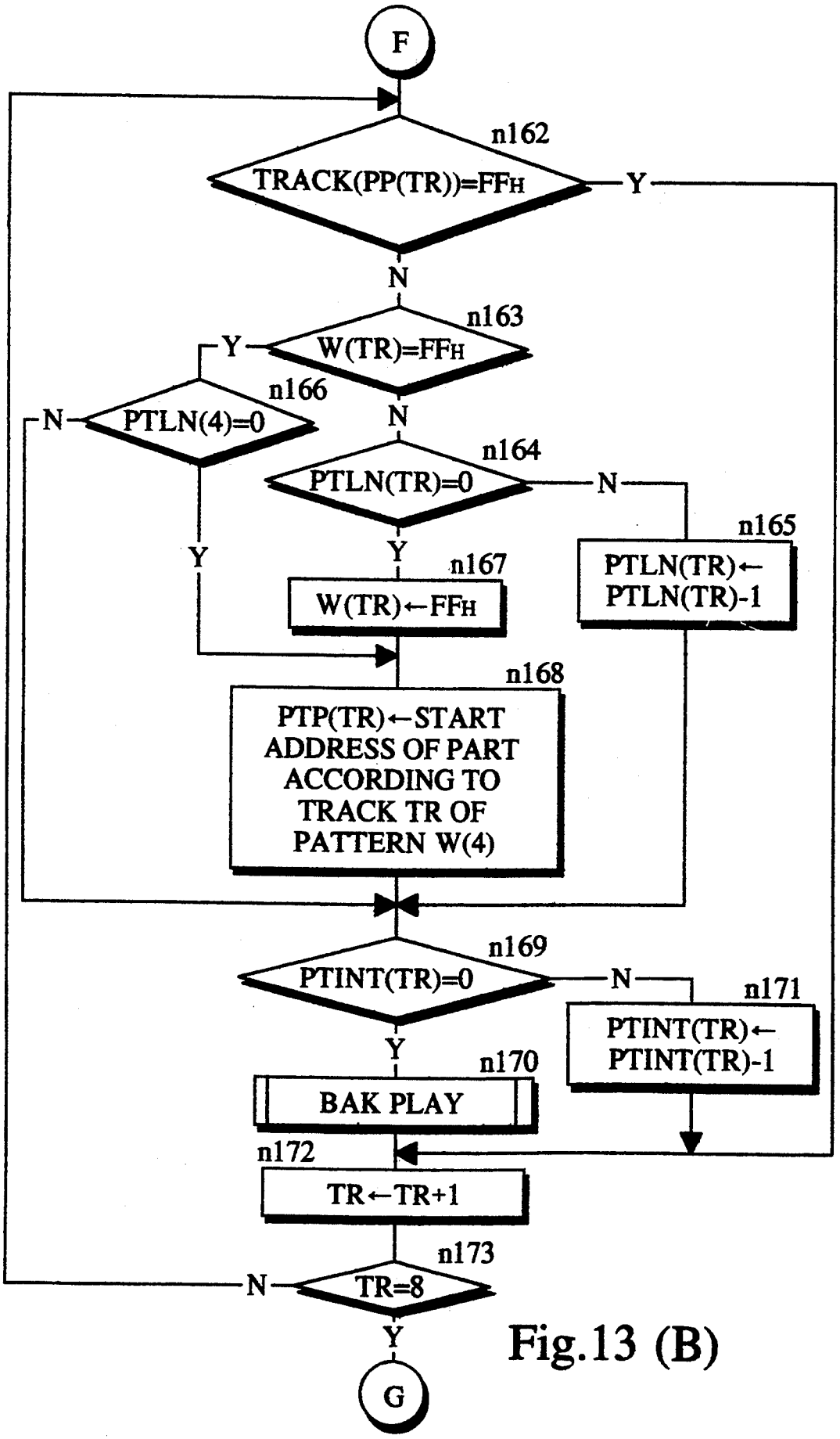
Figure 13:
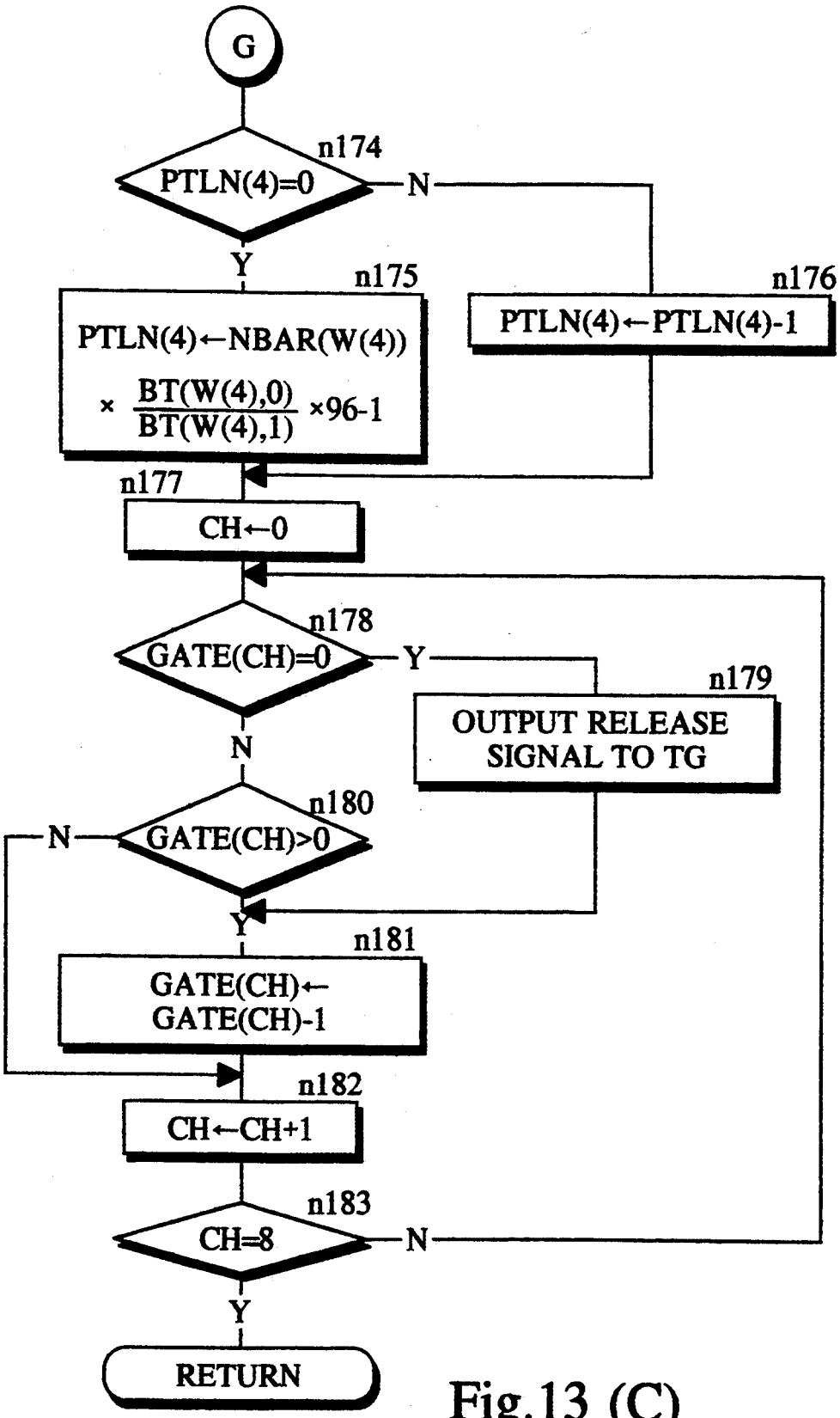

FIG. 13 shows a flow chart of the PLAY process.

In this process, playing musical data is read from the eight tracks of TR=0 to 7 to execute the automatic playing.

First, "0" is set into the track pointer TR (n150). Whether the interval data of the register TMINT(TR) in the track designated by the register TR is judged (n151). If the content of the register TMINT(TR) equals "0", the sequence playing process (SEQ process: see FIG. 14) is performed, otherwise, "1" is subtract from the register TMINT(TR) (n153). These steps are executed to the sequence tracks of TR=0 to 3 (n154 and n155). Similar operation is done to the accompaniment tracks of TR=4 to 7. That is, if the interval data of the register TMINT(TR) equals "0" (n156), the pattern setting process (see FIG. 15) is performed (n157), otherwise, "1" is subtracted from the register TMINT(TR) (n158).

The following description directs to the CBR tracks of TR=5 to 7. The process for the tracks is started from the step n161.

In this process, if any pattern designation data is written on the CBR tracks, the part data, in the accompaniment track of TR 4, corresponding to the designated section is replaced with the pattern designation data in the play mode. To do that, whether any pattern is presently designated in these tracks is judged (n162 and n163). If any pattern is designated, one unit (the value of the register PTLN(TR) set in FIG. 15) of the pattern is supplied to play automatically. That is, "1" is subtracted from the register PTLN(TR) (n165), after that, the backing play process (BAK PLAY process) is performed at the tone generation timing.

If no pattern is designated in the CBR tracks, the play back process of the pattern designated with the backing track is performed (n163 to n168). The play back process of the pattern of the backing track is repeated while the automatic musical playing is performed using the step n166.

After that, the count down step n176 is performed so that the accompaniment pattern length stored in the register PTLN which is designated by the backing track is decremented (n174 to n176). Further, to each channels of CH=0 to 7 (n177, n182, n183), the gate time in tone generation state is decremented (n181). If the gate time in any channel reaches "0", the release signal is supplied to the channel (n179).

Figure 14:
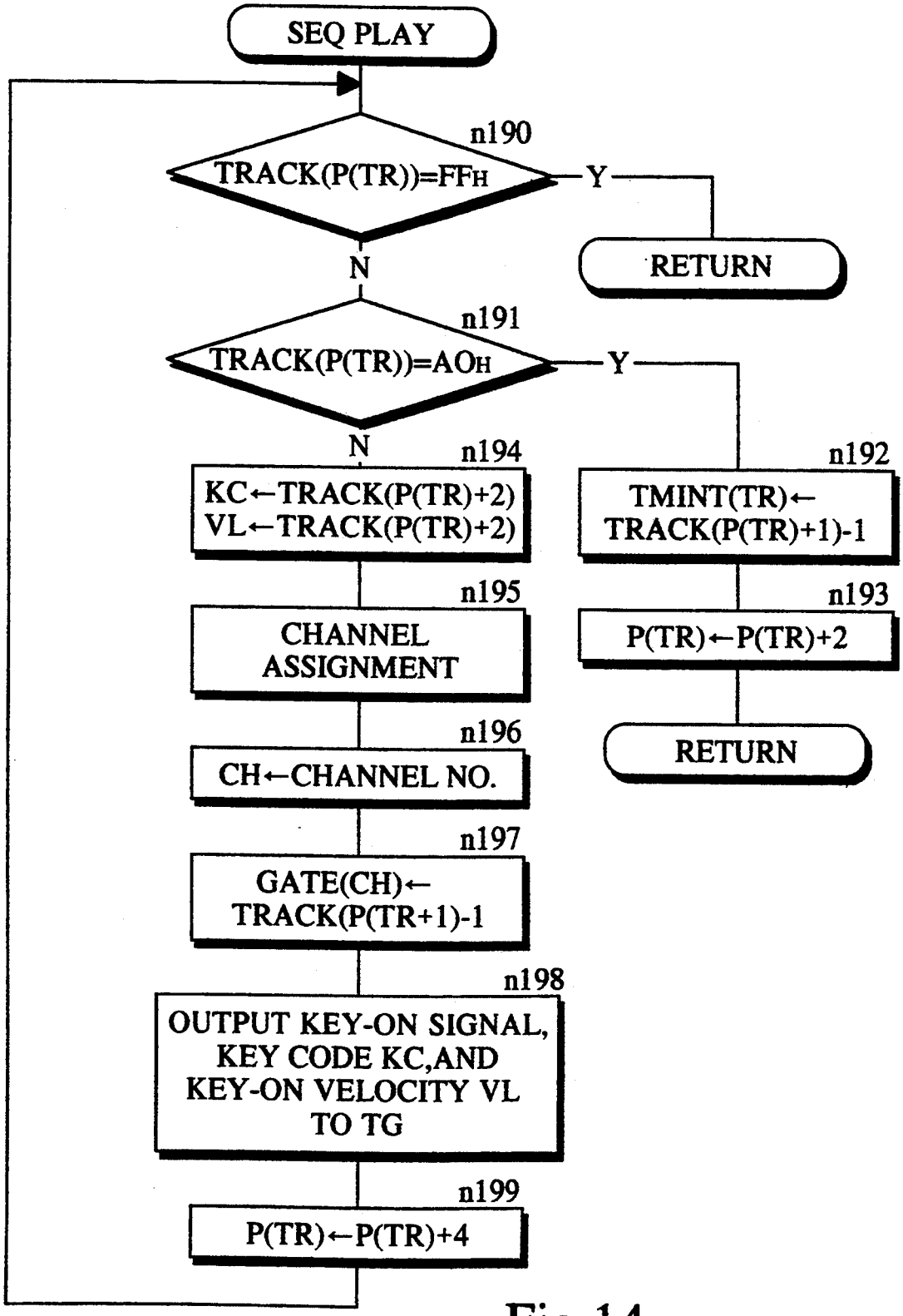

FIG. 14 shows a flow chart of the sequence playing process. In this process, first, whether the read data is note data, time interval data or end data is judged (n190, n191). If the read data equals the end code "FFH", the process returns (n190). Otherwise, if the data equals the time interval data "AOH", the read data is set into the register TMINT(TR) (n192), "2" is added to the pointer (n193), and the process returns. If the read data equals the note data "BOH", tone generation according to the note data is performed (n194 to n198). The tone generation process includes 1) reading of key code KC and key-on velocity VL (n194),
2) channel assignment (n195, n196),
3) gate time setting (n197), and
4) supplying the tone generation data to the tone generator (n198).

After that, the pointer proceed by four bytes the areas of which stores note data (n199), and the process returns to the step n190. That is, in this process, the steps from n194 to n199 are repeated until the time interval data or the end code is found.

Figure 15:
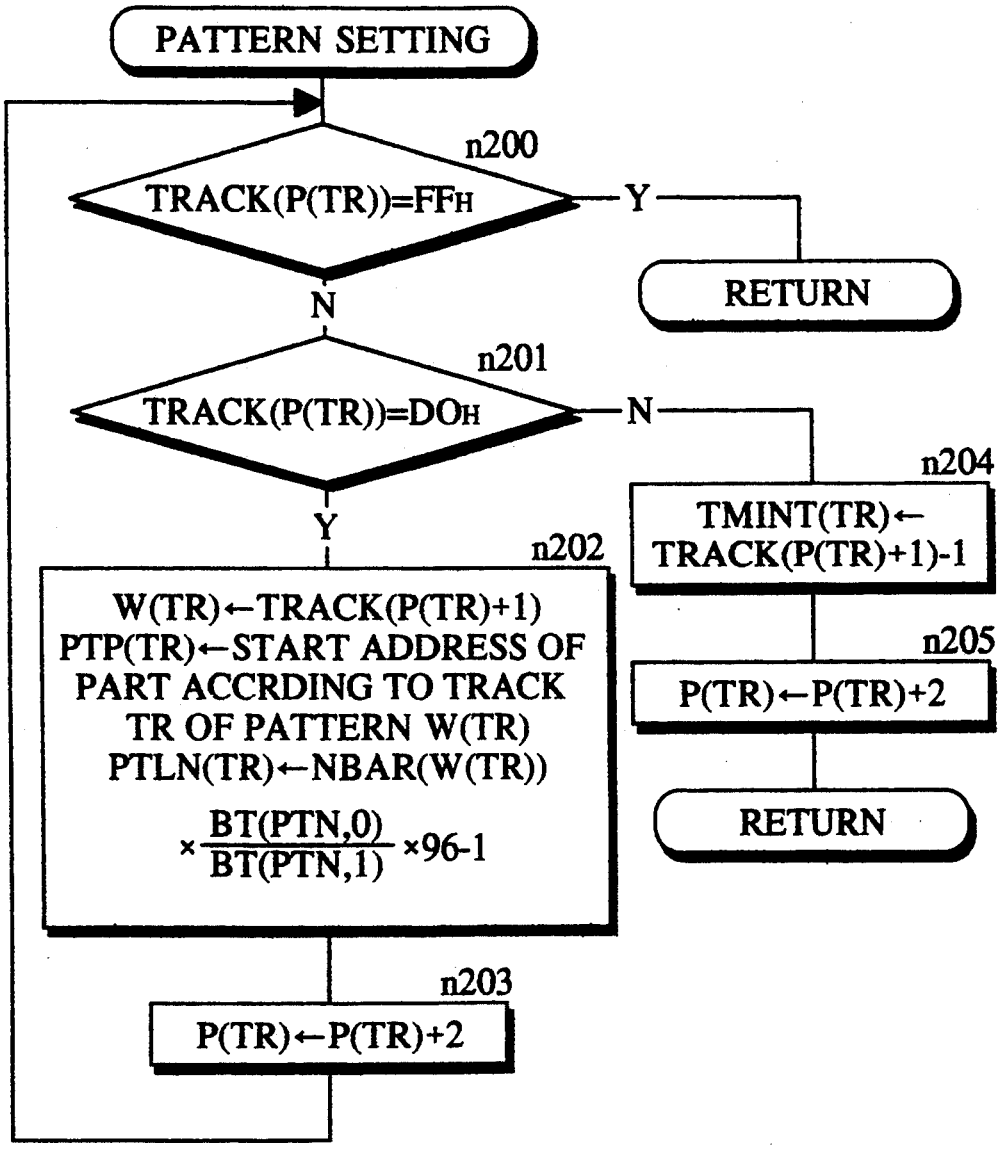

FIG. 15 shows a flow chart of the pattern setting process. In this process, reading preparation of an accompaniment pattern is performed based on data of the accompaniment track. If data of the accompaniment track equals "FFH", the process directly returns because the data of "FFH" means end of data (n200). If the data of the accompaniment track equals pattern designation data, the pattern number of the pattern designation data is read and set into the register W(TR), and the start address of the pattern is set into the register PTP(TR), (TR=5, 6, or 7). Further, the bar number representing the length of the pattern is converted into the number of the clocks, and the number of the clocks is set into the register PTLN(TR) (n202). Next, the pointer P(TR) proceeds by two to read the time interval until the next pattern designation data, and the process returns (n203). If the read data, at the step n201, is the time interval data, this data is stored into the register TMINT(TR) (n204). After that, the pointer P(TR) proceeds by two (n205), and the process returns.

Figure 16:
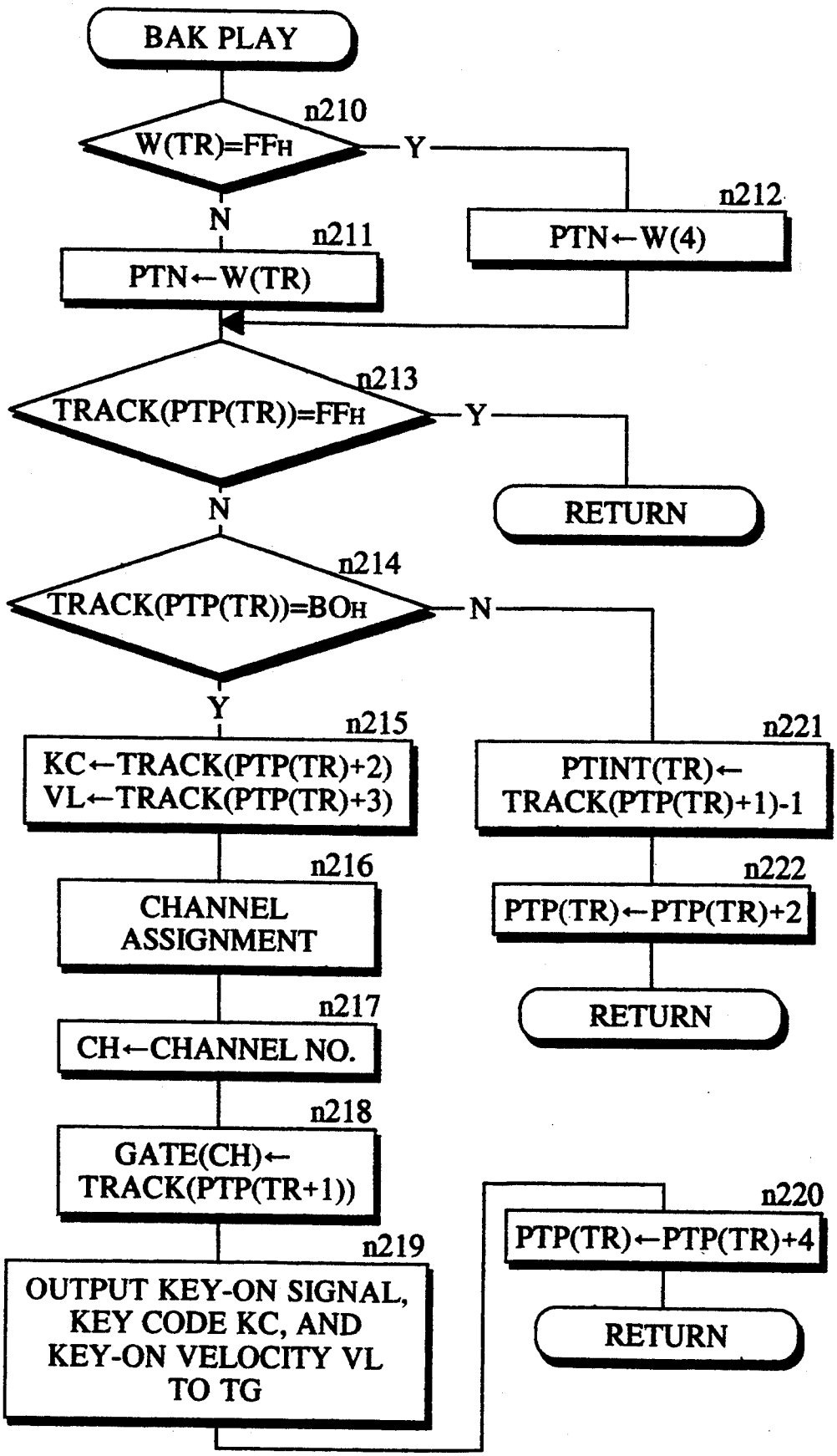

FIG. 16 is a flow chart of the backing playing process (BAK PLAY process). In this process, the accompaniment pattern data which is designated as accompaniment data is read to generate and release tones.

This process is performed regarding the tracks of TR=5 to 7. First, the designated pattern number of the register W(TR) is checked. If this number equals "FFH", that means there is no data to replace, so that the pattern number of the register W(4) is set into the register PTN (n212). If the number is not "FFH", the number is set into the register PTN (n211). Next, the musical playing data of the register PATTERN(PTN,TR,PTP(TR)), abbreviated as track (PTR(TR)) in the drawings, is read. If this read data equals the end data of "FFH", the process directly returns, otherwise, if it equals the note data of "BOH", the key code reading, the key velocity reading (n215), and the channel assignment (n216, n217) is performed. After that, the gate time is read and set into the register GATE(CH) (n218), the key-on signal, the key code, the key-on-velocity data and so on are supplied to the tone generator to start generation of tone (n219). Next, the pointer PTR(TR) proceeds by four (n220) and the process returns.

While, the read data is time interval data, this data is set into the register PTINT(TR) (n221). After that, the pointer PTP(TR) proceeds two (n222), and the the process returns.

As mentioned above, in this embodiment, the pattern in the backing track, and the pattern of the chord track, the base track and the rhythm track for the replacement can be designated as an accompaniment pattern. Therefore, editing of a pattern is very easy. In an embodiment of the present invention, a pattern number is written on the accompaniment track. In place of that, an accompaniment pattern data can be directly written on the accompaniment track. Also, data for replacement can be inputted in real time.

What is claimed is:

1. An instrument for recording and playing back musical playing data, comprising:

a first track means for storing first performance data;

a second track means for storing second performance data to replace the performance data in the first track means;

read out means for reading the first and second tracks simultaneously and for reading out the first performance data from the first track means and second performance data from the second track means at a predetermined timing;

tone generating means for generating musical tone based on the first performance data and for generating musical tone based on the second performance data switched with the first performance data in response to a reading out of the second performance data from the second track.

2. An instrument for playing back musical playing data according to claim 1, wherein the first performance data includes a plurality of performance part data and the second performance data includes one replacement-performance part data, and the tone generating means generates musical tone based on any one of the performance part data switched with the replacement-performance part data.

3. An instrument for recording and playing back musical playing data, comprising:

a first track means for storing first performance data;

a second track means for storing second performance data to replace the performance data in the first track means;

read out means for reading out the first performance data from the first track means and second performance data from the second track means at a predetermined timing; and tone generating means for generating musical tone based on the first performance data switched with the first performance data in response to a reading out of the second performance data from the second track;

wherein the first performance data in the first track means includes a plurality of performance part data, the second track means includes a plurality of tracks in each of which one replacement-performance art data is stored, and the tone generating means generates musical tone based on any one of the performance part data switched with the replacement-performance part data in any one of the tracks.

4. An instrument for playing back musical playing data according to claim 1, wherein said first and second performance data being pattern designation data which designates performance pattern data stored in a pattern memory, further comprising reading means for reading the pattern data designated with the pattern designation data from the pattern memory, and the pattern memory storing a plurality of sets of pattern data each of which is performance data having at least one bar length.

5. An instrument for playing back musical playing data according to claim 4, further comprising a sequence track in which sequence data is stored.

6. An instrument for playing back musical playing data according to claim 4, said pattern designation data is stored in said first track means and said second track means with timing data representing timing to be specified.

7. An instrument for playing back musical playing data according to claim 4, wherein each set of pattern data has a beginning address and the beginning address of said pattern data read by the reading means depends on read timing of said pattern designation data.

8. An instrument for playing back musical playing data according to claim 4, wherein pattern data specified with the first track means is read repeatedly till next pattern data is read.

9. An instrument for recording and playing back musical playing data, comprising:

a first track means for storing first performance data;

a second track means for storing second performance data to replace the performance data in the first track means;

read out means for reading out the first performance data from the first track means and second performance data from the second track means at a predetermined timing; and tone generating means for generating musical tone based on the first performance data switched with the first performance data in response to a reading out of the second performance data from the second track;

wherein said first and second performance data being pattern designation data which designates performance pattern data stored in a pattern memory, further comprising reading means for reading the pattern data designated with the pattern designation data from the pattern memory, and the pattern memory storing a plurality of sets of pattern data each of which is performance data having at least one bar length; and wherein the pattern designation data in the first and second track means designates the pattern data from a same group of pattern data.

10. An instrument for recording and playing back musical playing data, comprising:

a pattern memory for storing a plurality of performance pattern data;

a first performance data memory for storing first pattern designating data which designates performance pattern data stored by said pattern memory;

a second performance data memory for storing second pattern designating data to be switched with said first pattern designating data;

read out means for simultaneously reading said first and second performance data memories and for sequentially reading out said first and second pattern designating data;

said read out means for reading out performance pattern data from said pattern data memory in accordance with said first pattern data and, when said second pattern designating data is read out from said second performance data, switching said first pattern designating data with said second pattern designating data and reading out performance pattern data from said pattern data memory in accordance with said second pattern data.

11. A method for recording and playing back musical playing data, comprising the steps of:

storing first performance data with a first track;

storing second performance data with a second track, the second performance data to replace the performance data in the first track;

reading the first and second tracks simultaneously to read out the first performance data from the first track and second performance data from the second track at a predetermined timing;

generating musical tone based on the first performance data; and generating musical tone based on the second performance data switched with the first performance data in response to a reading out of the second performance data from the second track.

12. An instrument for recording and playing back musical playing data, comprising:

pattern memory means for storing a plurality of performance pattern data;

a first pattern specifying data memory means for successively storing first pattern specifying data, according to music progress, that specifies first performance pattern data from the pattern memory means;

a second pattern specifying data memory means for successively storing second pattern specifying data, according to the music progress, that specifies second performance pattern data from the pattern memory means, which is performed in place of the first performance pattern data;

pattern specifying data read means for successively reading out the first and second pattern specifying data from the first and second pattern specifying data memory means; and performance pattern data read means for normally reading out the first performance pattern data from the pattern memory means according to the first pattern specifying data read out from the first pattern specifying data memory means, and for reading out the second performance data from the pattern memory means according to the second pattern specifying data read out from the second pattern specifying data memory means when the second pattern specifying data is read out from the second pattern specifying data memory means.

13. An instrument for recording and playing back musical playing data according to claim 12, wherein each of said first and second pattern specifying data is stored together with timing data which represents a timing of whether said performance pattern data is changed to said first performance pattern data or said second performance pattern data in said first and second pattern specifying data memory means for each timing data.

14. An instrument for recording and playing back musical playing data according to claim 12, wherein said performance pattern data read means reads out repeatedly said first performance pattern data specified by said first pattern specifying data until new data of said first pattern specifying data is read out by said pattern specifying data read means.

15. An instrument for recording and playing back musical playing data according to claim 12, wherein said performance pattern data read means reads out again said first performance pattern data previously specified by said first pattern specifying data, after the reading out of said second performance pattern data specified by said second pattern specifying data is ended.

16. An instrument for recording and playing back musical playing data according to claim 12, further comprising pattern specifying data write means for writing any desired pattern specifying data into said first and second pattern specifying data memory means.

17. An instrument for recording and playing back musical playing data according to claim 12, further comprising performance pattern data write means for writing any desired performance pattern data into said pattern memory means.

* * * * *